US007913944B1

(12) United States Patent
Lombardi et al.

(10) Patent No.: US 7,913,944 B1
(45) Date of Patent: Mar. 29, 2011

(54) CABLE BRAKE FOR SEA DEPLOYMENTS OF LIGHT CABLE

(75) Inventors: Tammy Lombardi, Carlsbad, CA (US); Jeff GilChrist, Cardiff, CA (US); Aaron Bratten, La Mesa, CA (US); Lynn Collins, San Diego, CA (US); Steve Whiteside, San Diego, CA (US); Frank Gonzales, San Diego, CA (US); Kristin Smith, Carmel, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 526 days.

(21) Appl. No.: 12/132,091

(22) Filed: Jun. 3, 2008

(51) Int. Cl.
*B65H 59/14* (2006.01)

(52) U.S. Cl. ..... 242/419.7; 242/419.1; 242/419.3; 242/419.9; 242/563.2; 242/154; 226/195; 114/254

(58) Field of Classification Search ..... 242/416, 242/419, 419.1, 419.3, 419.6, 419.7, 419.8, 242/419.9, 563.2, 148, 153, 154, 156–156.2; 114/254, 230.21, 230.23; 254/286, 338, 254/393, 394, 395; 367/173, 165; 226/195
See application file for complete search history.

(56) References Cited

U.S. PATENT DOCUMENTS

| | | | | |
|---|---|---|---|---|
| 3,934,647 | A | | 1/1976 | Bokenkamp |
| 4,230,421 | A | | 10/1980 | Springett et al. |
| 4,269,540 | A | | 5/1981 | Uyeda et al. |
| 4,340,322 | A | | 7/1982 | Springett et al. |
| 4,345,855 | A | | 8/1982 | Uyeda et al. |
| 4,358,834 | A | * | 11/1982 | Swenson ..... 367/4 |
| 5,284,323 | A | | 2/1994 | Pawkett |
| 5,595,178 | A | | 1/1997 | Voss et al. |
| 5,692,509 | A | | 12/1997 | Voss et al. |
| 6,070,857 | A | | 6/2000 | Dragsund et al. |
| 6,116,345 | A | | 9/2000 | Fontana et al. |
| 6,276,454 | B1 | | 8/2001 | Fontana et al. |
| 6,328,502 | B1 | | 12/2001 | Hickey et al. |
| 6,484,920 | B1 | | 11/2002 | Selcer |
| 6,588,980 | B2 | | 7/2003 | Worman et al. |
| 6,702,221 | B2 | * | 3/2004 | Haber et al. ..... 242/421.4 |
| 6,752,384 | B2 | | 6/2004 | Matheson |
| 7,389,973 | B1 | * | 6/2008 | Chou et al. ..... 254/277 |
| 2003/0150201 | A1 | | 8/2003 | Matheson |
| 2005/0029476 | A1 | | 2/2005 | Biester et al. |

OTHER PUBLICATIONS

Marine Systems, Projects, Cable Brake System, http://www.spawar.navy.mil/depts/d70/d74/MarineSystems.html#project4 (Spring 2004).

* cited by examiner

*Primary Examiner* — William E Dondero
(74) *Attorney, Agent, or Firm* — Kyle Eppele; J. Eric Anderson

(57) ABSTRACT

A cable brake system for deployments of cable comprising: a frame configured to be mounted on a ship; a repeater supporting track mounted longitudinally to the frame, the supporting track being configured for slidingly supporting a plurality of repeaters; a spool positioned exterior to the frame, the spool having the cable wrapped therearound and being capable of supplying the cable to an interior of the frame; at least one planar surface on an interior of the frame, the planar surface being positioned approximately parallel to the repeater supporting track; and a plurality of brake sub-assemblies being supported by the planar surface in a manner so as to establish a serpentine path for the cable and to impart variable frictional resistance to the cable.

11 Claims, 6 Drawing Sheets

CABLE BRAKE FOR SEA DEPLOYMENTS OF LIGHT CABLE

FEDERALLY-SPONSORED RESEARCH AND DEVELOPMENT

This invention (Navy Case No. 96,881) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice 619-553-2778; email T2@spawar.navy.mil.

BACKGROUND

There are several challenges associated with the deployment of fiber-optic cable in water. To prevent wasteful, unrestrained payout of the cable, especially in deep water, tension is typically applied to the cable by way of capstans or hand tension. These previous techniques have draw-backs, however, such as cable damage in the event of a cable snag, limited sequential in-line sensor deployment capability, and lack of precision/control. A need exists for a system with improved functional capability and greater control of optical-cable deployment.

DETAILED DESCRIPTION

Figure 1A:
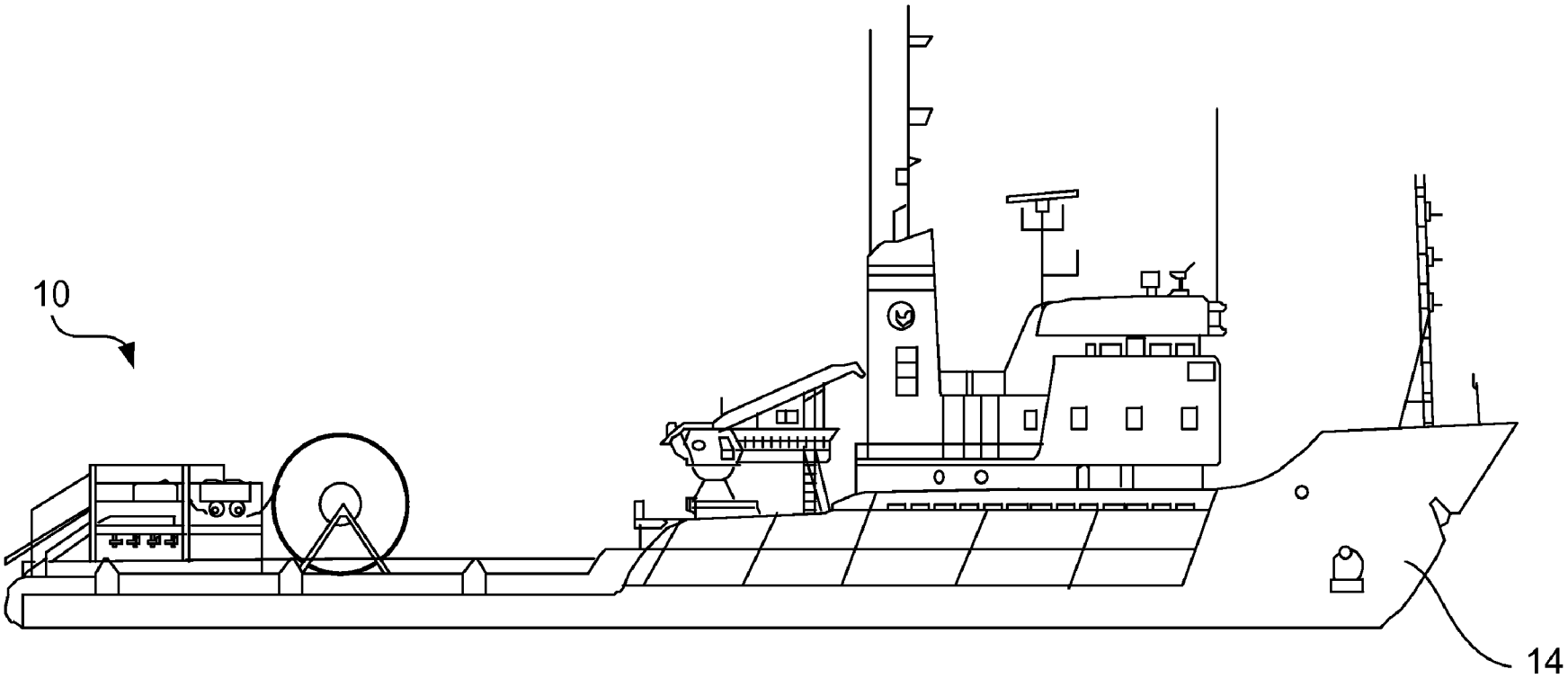
FIG. 1*a* shows a schematic of a ship equipped with the presently disclosed system.
Figure 1B:
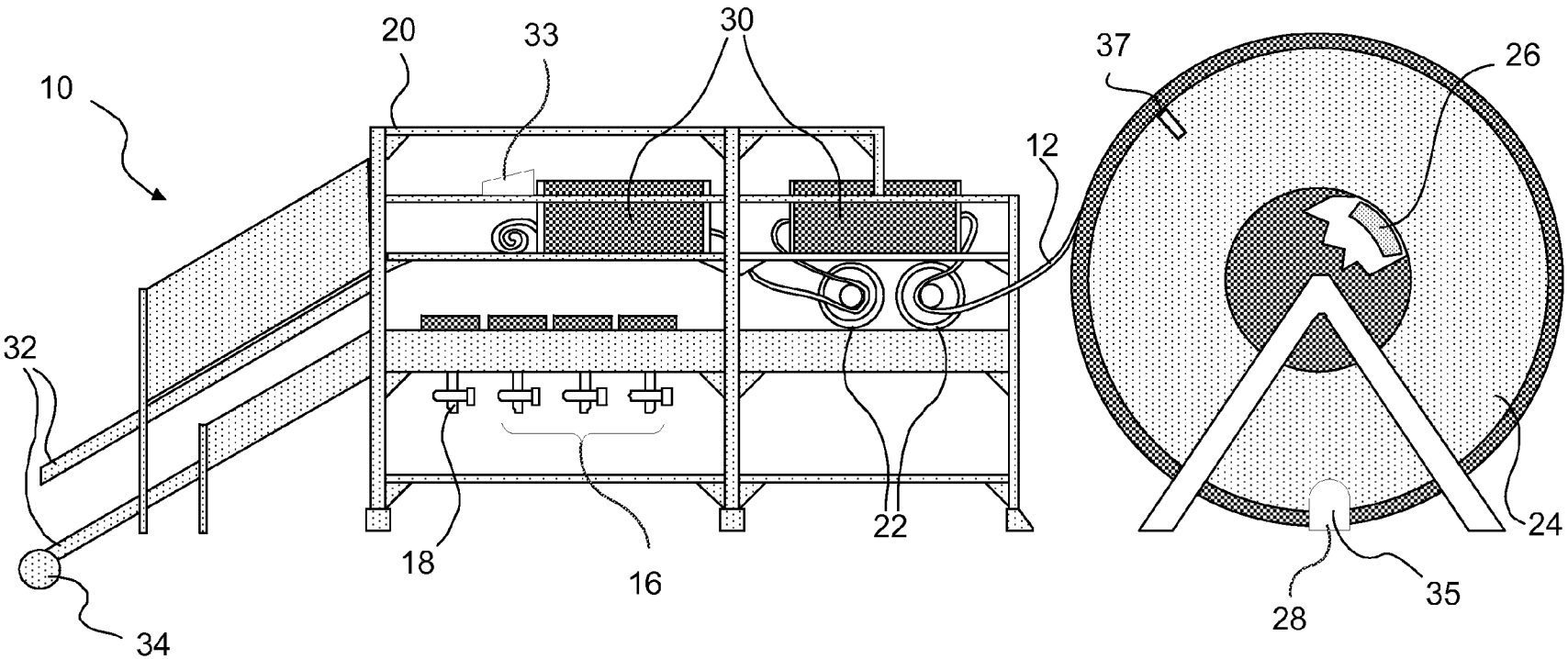
FIG. 1*b* shows a side view of a cable brake system.

FIGS. 1*a* and 1*b* show a cable brake system 10 for deployments of light cable 12, e.g. fiber optic cable, into water. The cable brake system 10 has the ability to control and monitor the tension, deployment speed, and the amount/length of cable 12 that has been deployed off of a ship 14. The cable brake system 10 comprises a plurality of brake sub-assemblies 16, and a sensor assembly 18. The brake sub-assemblies 16 and the sensor assembly 18 are mounted to a frame 20, which may be mounted to the deck of the ship 14. The brake sub-assemblies 16 may be positioned on the frame 20 to produce a serpentine cable path when activated. Both the braking force and the position of the brake sub-assemblies 16 are adjustable so that the amount of tension on the cable 12 may be regulated to correspond with the depth of the water, the speed of the ship 14 and the amount of slack desired. Although FIG. 1*b* shows the brake sub-assemblies 16 as comprising three brake sub-assemblies, it is to be understood that the brake sub-assemblies 16 may comprise any number of brake sub-assemblies that is greater than or equal to two. As shown in FIG. 1*b*, the sensor assembly 18 is positioned on the frame 20 aft of the brake sub-assemblies 16.

The cable 12 may be stored in cable packs 22 and on a larger spool 24. Cable packs 22 may be formed by winding cable 12 within a binder material (e.g. glue) that, when cured, holds the cable 12 in-place within the cable packs 22. Several wraps of the cable 12 are also wound on to the spool 24, which has an internal spool brake 26 (shown in a cutaway section of the spool 24 in FIG. 1*b*) (i.e. rotational speed of the spool 24 can be slowed by its own the spool brake 26). The spool 24 can also be equipped with a spool rotation sensor 28 that serves as an approximate measure of the length of cable that has passed out of the spool 24. The combined use of the spool 24 and the cable packs 22 on the cable brake system 10 allows for both pay-out of cable 12 and for in-line sensors 30 (fiber optic signal repeaters or similar) to be smoothly deployed. Over-boarding guides 32 may be mounted to the frame 20 to guide the cable 12 and the in-line sensors 30 as they are deployed off the ship 14. The over-boarding guides 32 have a gradual negative slope to drop the in-line sensors 30 overboard as necessary. Deployment of the in-line sensors 30 may be electronically initiated via an in-line sensor release mechanism 33 and may be governed by a drive to achieve smooth deployment. One embodiment of the spool rotational sensor 28 utilizes a light source 35 and a reflective surface 37 on a side of the spool 24 such that each time the reflective surface passes the spool rotational sensor 28 senses the reflected light from the reflective surface. It is to be understood that the spool rotational sensor 28 may be any sensor capable of sensing the rotation of the spool 24.

Figure 5:
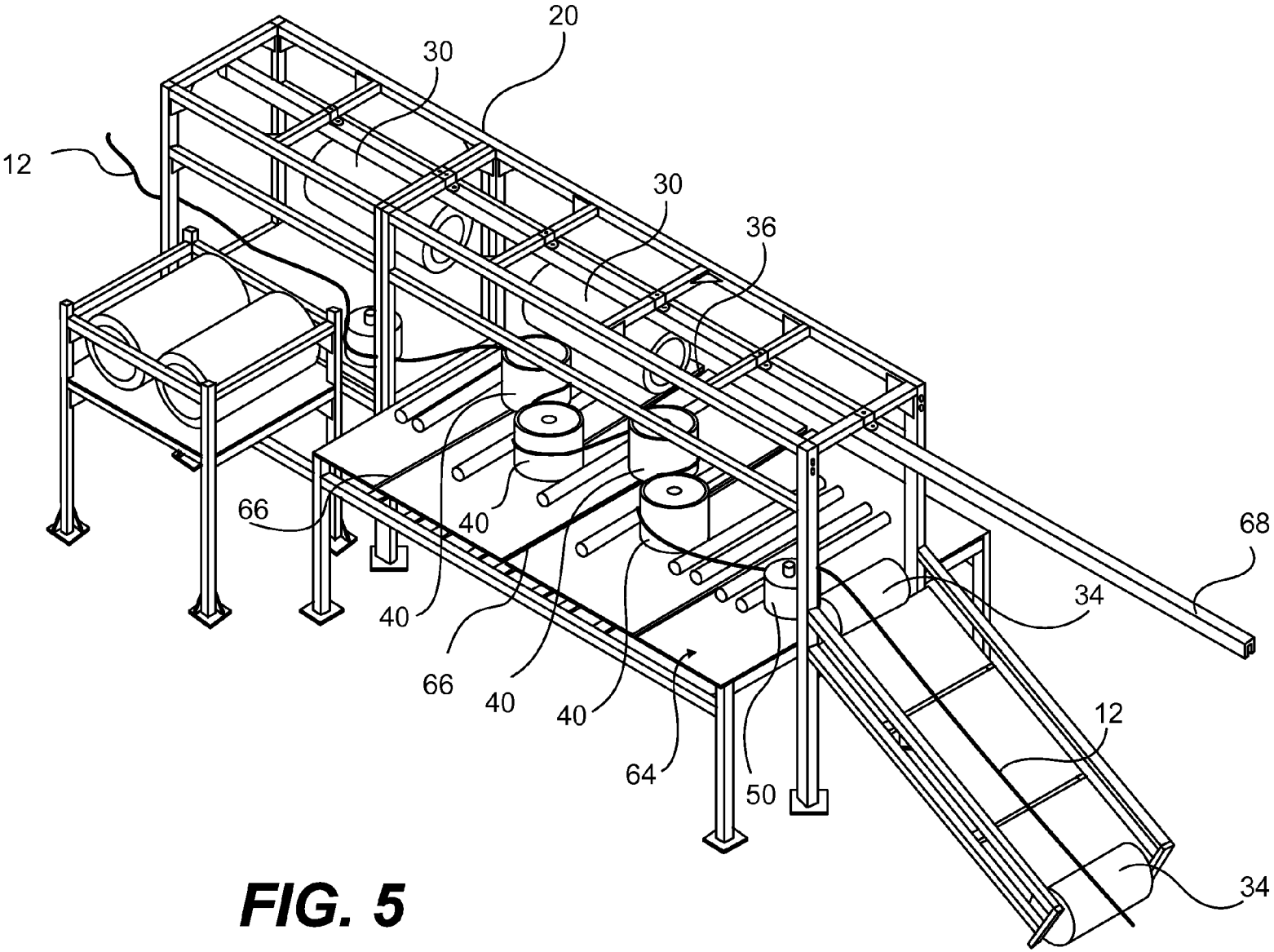
FIG. 5 shows perspective view of a cable brake system.

The frame 20 can be constructed of structural members necessary to support cable packs 22, in-line sensors 30, brake sub-assemblies 16, and the over-boarding guides 32. Space frame construction of the frame 20 may be employed to lower the weight of the cable brake system 10, while allowing ample load-bearing capacity and mounting options for the mechanical interface to the ship 14's deck. Each element of the cable brake system 10 may be constructed using components that resist corrosion in a marine environment. Cable rollers 34 may be positioned at the aft end of the over-boarding guides 32 (as shown in FIG. 1*b*) and between the brake sub-assemblies 16 (as shown in FIG. 5).

Figure 2:
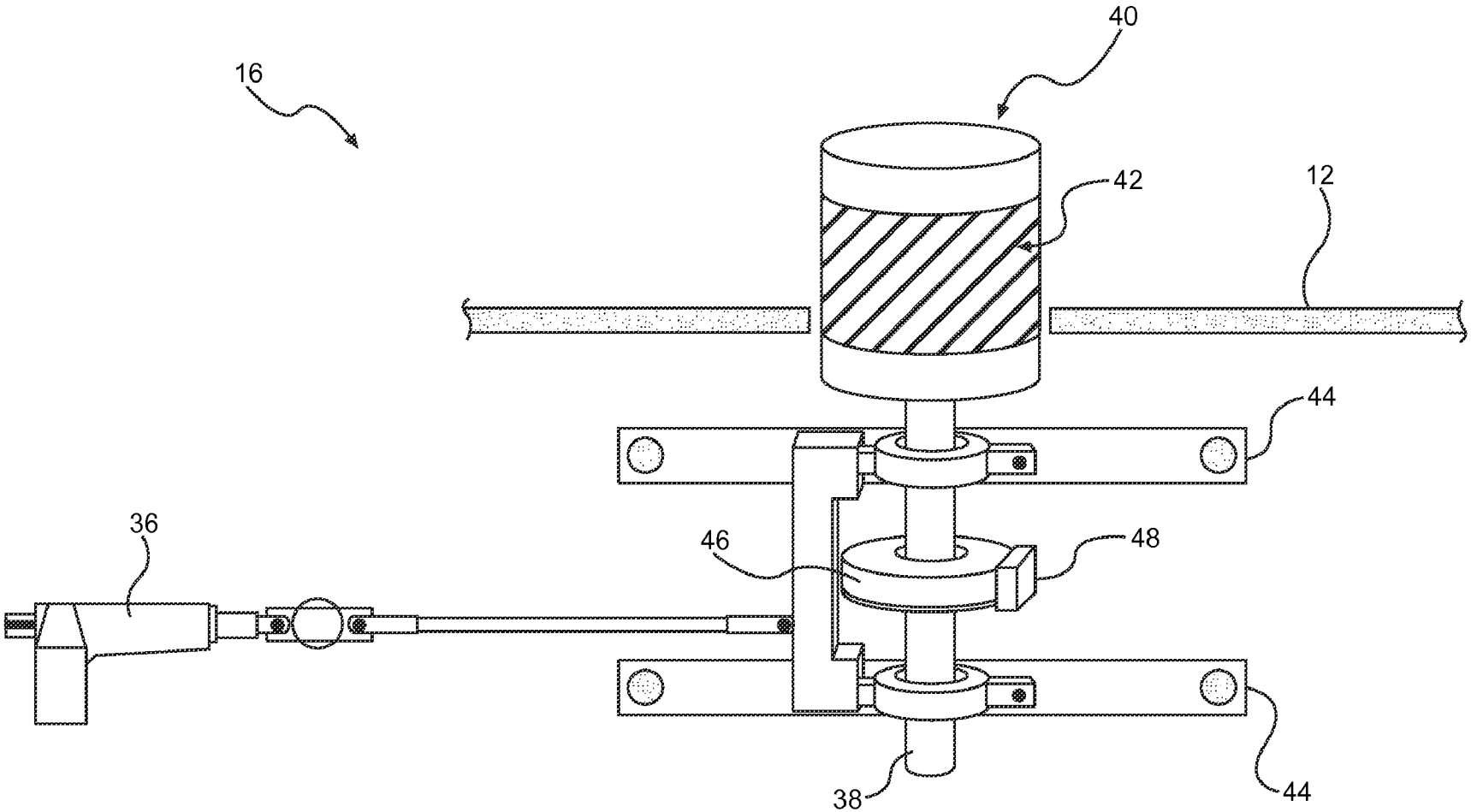
FIG. 2 shows an actuator/brake-hub sub-assembly.

FIG. 2 shows an embodiment of an individual brake sub-assembly 16. Each brake sub-assembly 16 includes an actuator 36 mechanically coupled to a brake shaft 38, which is keyed to a brake hub 40. The brake hub 40 has an outer covering 42 that has a high coefficient of friction, such as rubber, to grip the cable 12 more effectively. The actuator 36 may be any type of actuator capable of moving the brake sub-assembly 16 with respect to the frame 20, such as hydraulic, electrical, and/or mechanical actuators. Each actuator 36 is configured to move its corresponding brake sub-assembly 16 along a track (not shown) that is connected to the frame 20 through stabilizing bars 44. The actuator 36 repositions the brake shaft 38 with respect to the brake shafts 38 of other brake sub-assemblies 16 as necessary, i.e., the actuator 36 brings the brake shaft 38 closer to or pushes it farther from another brake shaft 38. The brake sub-assemblies 16 are positioned such that; when activated, each brake sub-assembly 16 is positioned, in series, along a centerline and the cable 12 moves in a serpentine path around the brake hubs 40. The serpentine path created by the cable 12 may be seen in FIG. 5. When de-activated, the brake hubs 40 move outward, alternately on one side or the other of the centerline cable-path, and the cable 12 passes freely through the straight-line path without experiencing braking action. When activated, the brake sub-assemblies 16 produce tension in the cable 12 during deployment. In the limit, the brake sub-assemblies 16 can also be used to hold the cable 12 steady, without any deployment. In addition, each of the brake sub-assemblies 16 comprises a brake rotor 46 and a caliper 48, which provide the braking force. During operation, any single brake sub-assembly 16 can impart resistance to cable 12 payout; up to the point that the cable 12 starts slipping on the outer covering 42.

At specified intervals during a cable deployment, an in-line sensor 30 can be deployed by momentarily opening the serpentine brake arrangement, previously described, and passing the in-line sensor 30. Once the in-line sensor 30 has passed, the serpentine cable-path is re-established and braking is activated again. This is accomplished by a control system, which commands the actuators 36, which move the brake sub-assemblies 16. In one example embodiment, the in-line sensor may be a cylindrical repeater/amplifier with an approximate 20-inch diameter. It is to be understood that the in-line sensor 30 is not limited to cylinders, but may be any size or shape. The in-line sensor 30 can be deployed in-line/mid-span of the cable 12 being deployed by temporarily deactivating the brake sub-assemblies 16 and allowing the in-line sensor 30 to be deployed through the over-boarding guides 32. This function may be accomplished by a processor 62, described below.

Figure 3:
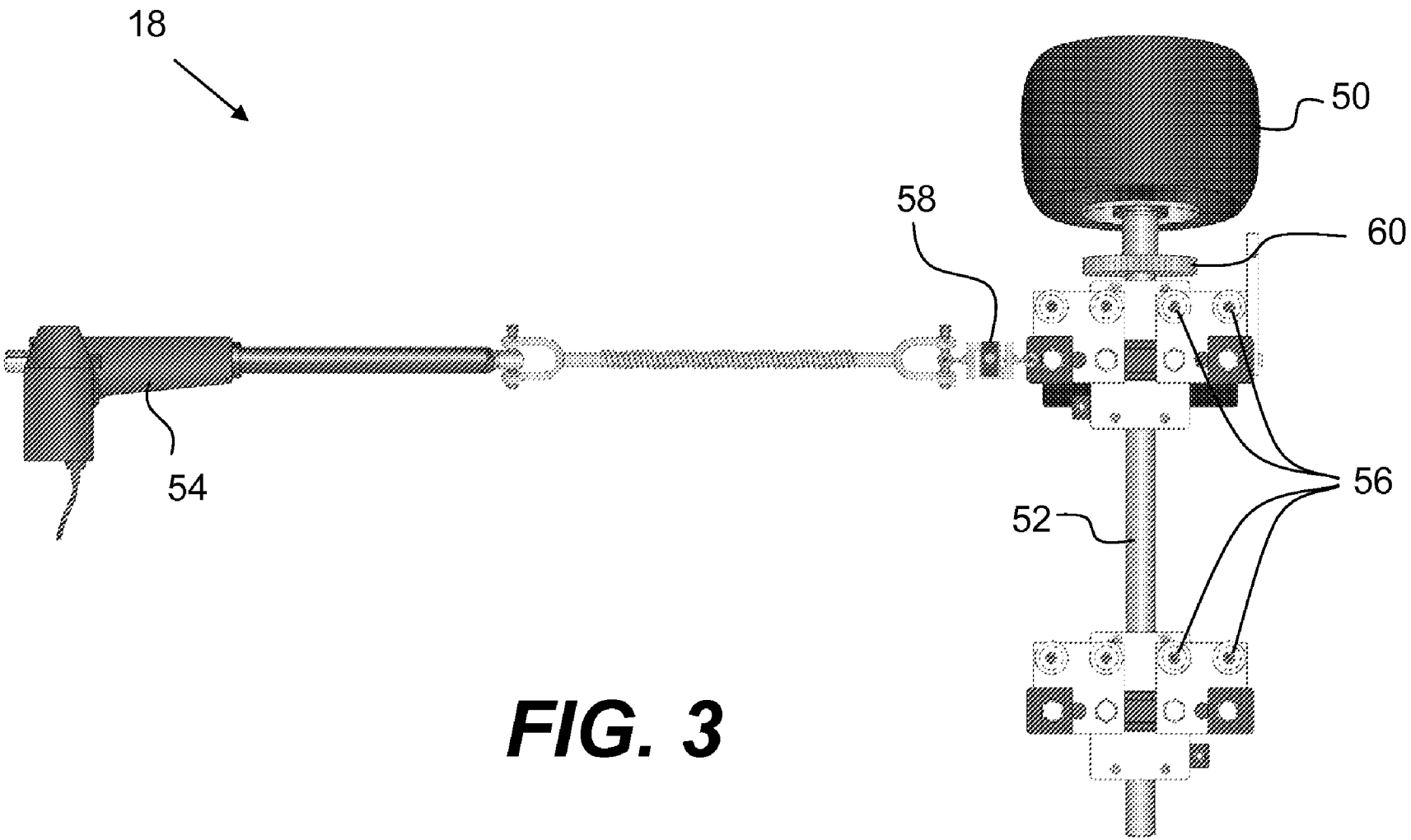
FIG. 3 shows a perspective view of a sensor assembly.

FIG. 3 shows an embodiment of the sensor assembly 18. The sensor assembly 18 comprises a sensor hub 50 that is keyed to a sensor shaft 52. The sensor shaft 52 is coupled to a sensor actuator 54 that is configured to slide the sensor assembly 18 on trolleys 56 to and fro along a track (not shown) that is mounted to the frame 20. The sensor assembly 18 also comprises a force transducer 58, such as a tensometer, and a hub rotation sensor 60. The force transducer 58 may be used to measure a tension value of the cable 12. The hub rotation sensor 60 may be used for measuring rotations per minute of the sensor hub 50 and, as a result, for measuring the deployment speed of cable 12. When the sensor hub 50 is allowed to rotate freely the sensor assembly 18 can determine the amount of tensile force on the cable 12 by pressure applied by the cable 12 against the sensor hub 50.

Figure 4:
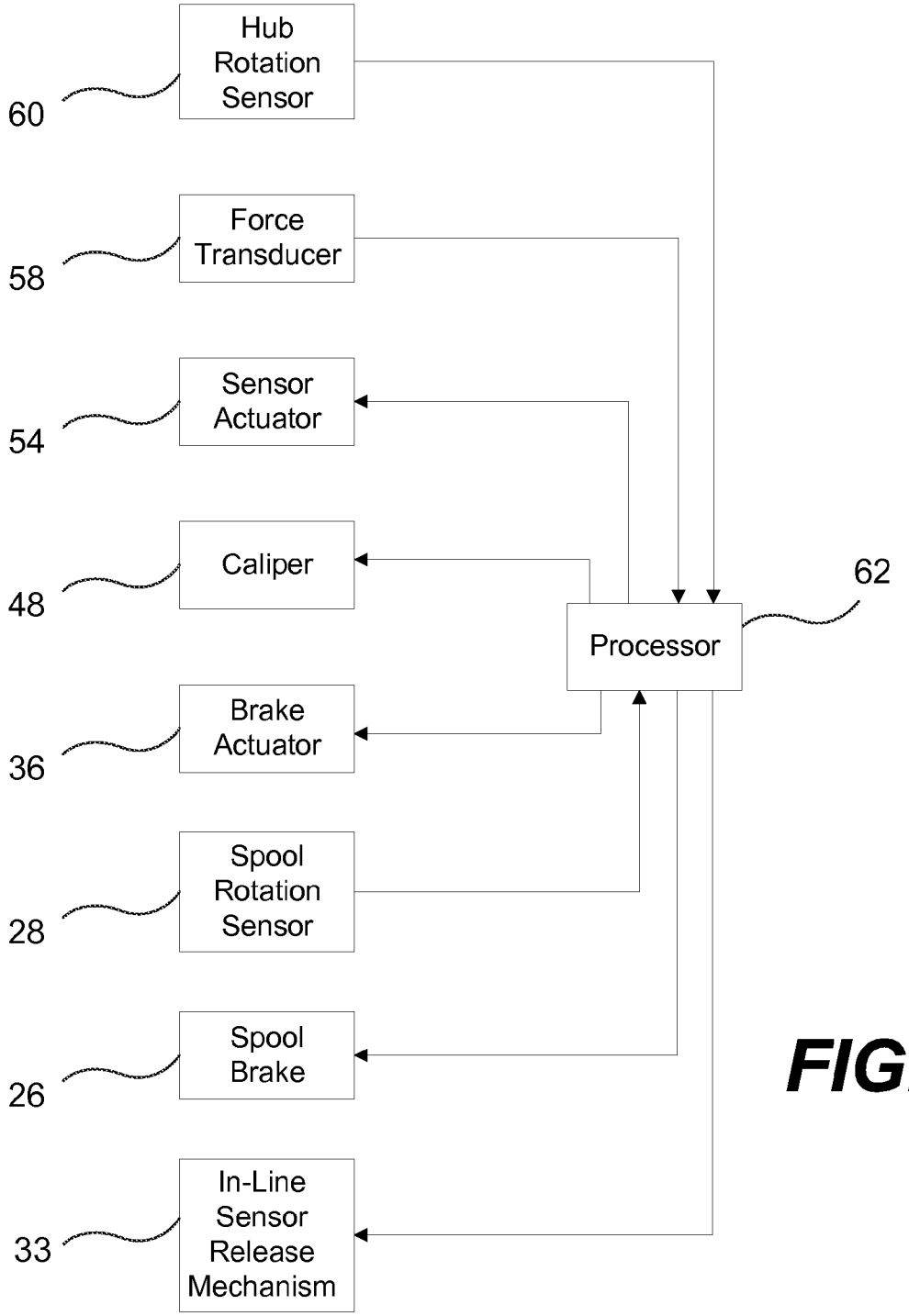
FIG. 4 shows a sensor for counting revolutions of a drum.

FIG. 4 is a diagram showing the relationships between the previously described elements of the cable brake system 10 and a processor 62. The processor 62 may be configured to receive sensor hub rotational information from the hub rotation sensor 60, tension information from the force transducer 58, and spool rotation information from the spool rotation sensor 28. The processor 62 may be configured to control the spool brake 26, the brake actuators 36, the brake calipers 48, the sensor actuator 54, and the in-line sensor release mechanism 33. The processor 62 may be used to determine tension, speed and deployed-length of the cable 12. The deployed-length and payout speed may be calculated directly using the rotational velocity data from the hub rotation sensor 60, together with a running clock in the processor 62, and the known constants associated with the sensor hub 50 geometry (one hub revolution equals one hub perimeter of cable that has been deployed). The hub rotation sensor 60 counts the number of rotations per specific period of time of the sensor hub 50.

The processor 62 conducts data acquisition and is also capable of applying deployment logic to make braking decisions. The processor 62 can be programmed to modulate the braking force at any or all of the brake sub-assemblies 16 by controlling the brake calipers 48 on the brake rotors 46. Additionally, the processor 62 can also activate or deactivate the brake system 10 by controlling the actuators 36 and the sensor actuator 54. With comprehensive programming (software), the processor 62 could manage the entire test sequence for a cable deployment mission. Lab-view™ software is a suitable example of software that may be used with the processor 62 to perform the above-described operations. The brake system 10 can automatically provide more tension during payout in deeper water (where a run-away deployment condition could occur if the cable 12 is not restrained) and less tension in shallow water (where there is a lower likelihood of the run-away condition). Upper limit thresholds for tension could also be set to avoid cable damage if the cable 12 was inadvertently snagged or pulled during the deployment.

FIG. 5 shows a perspective view of one embodiment of the cable brake system 10. In the embodiment shown in FIG. 5, the brake sub-assemblies 16 are provided on a horizontal planar surface 64 of the cable brake system 10. The horizontal surface 64 has tracks 66 along which the brake sub-assemblies 16 and the sensor assembly 18 can slide. When the processor 62 determines that the cable 12 is being deployed too fast or too slow, the processor 62 signals the actuator 36 of each of the brake sub-assemblies 16 to move their corresponding brake shafts 38 toward or away from the cable 12 thereby, respectively applying more or less pressure on the cable 12 by the brake hubs 40. For storage and deployment of in-line sensors 30, a deployment track 68 may be mounted to the frame 20. The in-line sensors 30 may be configured to slide along the deployment track 68 once released by the in-line sensor release mechanism 33.

The previous description of the disclosed functions is provided to enable any person skilled in the development process for a similar concept to make or use the present inventive subject matter. Various modifications to these functions will be readily apparent and the generic principles defined herein may be applied to additional functions without departing from the spirit or scope of the inventive subject matter. For example, one or more of the brake system functions can be rearranged and/or combined, or additional functional elements may be added. Thus, the present inventive subject matter is not intended to be limited to the set of functions shown herein but is to be accorded the widest scope consistent with the principles and novel features disclosed herein.

It will be understood that many additional changes in the details, materials, steps and arrangement of parts, which have been herein described and illustrated to explain the nature of the invention, may be made by those skilled in the art within the principal and scope of the invention as expressed in the appended claims.

We claim:

1. A cable brake system for deployments of cable comprising:

a frame configured to be mounted on a ship;

a repeater supporting track mounted longitudinally to said frame, said supporting track being configured for slidingly supporting a plurality of repeaters;

a spool positioned exterior to said frame, said spool having the cable wrapped therearound and being capable of supplying said cable to an interior of said frame;

at least one planar surface on an interior of said frame, said planar surface being positioned approximately parallel to said repeater supporting track; and a plurality of brake sub-assemblies being supported by said planar surface in a manner so as to establish a serpentine path for the cable and to impart variable frictional resistance to the cable.

2. The cable brake system for deployments of light cable of claim 1, further comprising a counter, wherein said counter comprises a light reflective surface on said spool and a light emitting device positioned on a deck of said ship, said light emitting device configured for emitting light toward said spool and receiving light from said light reflective surface.

3. The cable brake system for deployments of light cable of claim 2, further comprising a data acquisition system for storing a value representing a deployment speed of the cable and a cumulative length of cable that has passed through said cable brake system.

4. The cable brake system for deployments of light cable of claim 3, wherein said light emitting device is configured to record a number of times said reflective surface reflects light emitted by said light emitting device back toward said light emitting device.

5. The cable brake system for deployments of cable of claim 4, further comprising an actuator and a controller, wherein said controller is configured to receive data from said counter and further configured to be responsive to data acquired by said acquisition system and wherein said controller is further configured to apply a braking force through said actuator to at least one of said plurality of brake sub-assemblies.

6. The cable brake for deployments of cable of claim 1, wherein each of said brake sub-assemblies comprises an actuator and a hub which are both connected to a shaft, with a surface of said hub being covered by a material capable of gripping the light cable and preventing slipping during deployment.

7. The cable brake system for deployments of cable of claim 1, further comprising an actuator that is connected to at least one of said plurality of brake sub-assemblies.

8. The cable brake system for deployments of cable of claim 1, further comprising a sensor assembly and rotational counter for measuring a tension value and a pay-out rate of the cable.

9. The cable brake system for deployments of cable of claim 1, further comprising an overboarding guide connected to an aft end of said frame, said overboarding guide configured for guiding said repeaters away from said ship.

10. A cable brake for deployment of fiber-optic cable and in-line sensors into water comprising:

a frame configured to be mounted to a ship;

a plurality of brake sub-assemblies adjustably positioned on the frame wherein each brake sub-assembly comprises a hub and a processor-controlled hub brake, and wherein the positions of the hubs of the brake sub-assemblies are continuously adjustable from an open configuration that allows in-line sensors to pass freely between the hubs to a configuration that establishes a serpentine path for the cable through the hubs, and wherein each processor-controlled hub brake is configured to provide variable braking force to each corresponding hub;

a force transducer mounted to the frame and configured to measure the tension on the cable after the cable has left the brake sub-assemblies;

a cable deployment speed sensor configured to measure the speed at which the cable is deployed;

a processor configured to adjust the braking force of the brake sub-assemblies based on tension and cable deployment speed information received from the force transducer and the cable deployment speed sensor respectively;

wherein each brake sub-assembly further comprises a processor-controlled actuator configured to move the corresponding brake assembly in a direction that is approximately perpendicular to the direction of the cable deployment;

a cable spool configured to provide cable to the cable brake, wherein the cable spool comprises a processor-controlled internal brake operatively coupled to the processor, wherein the cable spool further comprises a rotational sensor configured to send cable spool rotational information to the processor;

cable packs mounted to the frame and configured to store cable for the cable brake; and an in-line sensor-support track mounted to the frame such that when the frame is mounted to the ship the in-line sensor-support track is configured to allow an in-line sensor to slide along the length of the in-line sensor-support track and drop into the water.

11. The cable brake of claim 10, further comprising a processor-controlled in-line sensor release mechanism configured to release an in-line sensor upon a command from the processor.

* * * * *